United States Patent [19]

Wise

[11] 4,069,600

[45] Jan. 24, 1978

[54] ATHLETIC FOOT PROTECTOR

[76] Inventor: Leslie E. Wise, 3069 Highland Drive, Smyrna, Ga. 30080

[21] Appl. No.: 582,870

[22] Filed: June 2, 1975

[51] Int. Cl.[2] ..... A43B 17/08; A43B 17/14

[52] U.S. Cl. ..... 36/10; 2/2; 2/61; 2/239

[58] Field of Search ..... 2/239, 240, 2, 241, 2/61, 22, 243 R; 128/165, 168, 24 R, 293, 166; 36/10

[56] References Cited

U.S. PATENT DOCUMENTS

| | | | |
|---|---|---|---|
| 1,074,595 | 10/1913 | Aumont | 2/239 X |
| 1,637,285 | 7/1927 | Sheehan | 2/239 X |
| 1,775,714 | 9/1930 | Bass | 2/239 X |
| 1,805,035 | 5/1931 | Branley | 2/239 X |
| 2,702,998 | 3/1955 | Purcell | 2/239 X |
| 3,028,857 | 4/1962 | Parker | 128/24 R X |
| 3,216,973 | 11/1965 | Britain | 2/239 X |
| 3,259,915 | 7/1966 | Dison | 2/239 |
| 3,605,122 | 9/1971 | Myers | 2/239 |

FOREIGN PATENT DOCUMENTS

| | | | |
|---|---|---|---|
| 270,033 | 5/1927 | United Kingdom | 36/10 |

*Primary Examiner*—H. Hampton Hunter
*Attorney, Agent, or Firm*—James B. Middleton

[57] ABSTRACT

An athletic foot protector comprising a porous elastic sock, the elastic sock being about one size smaller than the foot so that the sock is stretched in all directions in covering the foot to assure that there is no motion between the foot and the elastic sock, thereby providing a protective covering to receive potentially traumatic abrasion.

3 Claims, 3 Drawing Figures

ATHLETIC FOOT PROTECTOR

This invention relates to skin protecting means, and is more particularly concerned with a foot protecting means for athletes and the like.

In numerous sports such as basketball, tennis and football, the players must make frequent stops and changes of directions while running rather fast. The shoes for these various sports are well adapted to allow the players to make the quick turns and stops: basketball shoes have rubber soles to grip the wood floor, football shoes have cleats, etc. The problem remaining is protection for the foot within the shoe.

A player normally wears a substantially conventional knit sock within a shoe for playing a sport. The sock is reasonably soft in an effort to prevent abrasion, and is relatively thick to absorb perspiration in an effort to maintain maximum comfort for the player. However, since a knit sock cannot fit extremely tightly without causing discomfort there is in fact a considerable amount of motion between the player's foot and the sock.

Thus, when a player is required to make sudden stops from a full run, and to change directions suddenly while running fast, the foot slides in the sock at a time when a large force is exerted by the foot against the sock. This results in the sock's rubbing against the foot with a large frictional force.

Due to this rubbing of the sock against the foot, and especially with the large forces involved, callouses are formed on the bottom of the player's feet. Continued playing of the sports results in even larger callouses; and, eventually, the callouses become so large that the same forces that originally caused the callouses tend to tear the callouses from the foot. This of course results in badly injured feet that are extremely sore and very subject to infection unless properly cared for.

In the past, the efforts to solve the above discussed problem have included such expedients as taping the feet with adhesive tape. Wile this may reduce the problem somewhat, the additional problem of removing the tape is introduced. Removal of the tape by simply pulling it off can be painful, and much adhesive is left on the feet. Removal of the tape and/or the adhesive by a solvent reduces the pain, but effective solvents dry the skin and are themselves undesirable for frequent contact. Another prior art attempt to solve the above stated problem comprises a coating for the feet. While such a coating can be of some assistance in receiving some of the abrasion, the coating is very difficult to remove. In addition, the coating simply lies on the surface of the skin and cannot assist in holding the skin of the foot firm.

The present invention provides an admirable solution to the above stated problem without the attendant difficulties of the prior art. The present invention comprises an elastic foot covering that adheres tightly to the entire foot. The foot covering is formed in substantially the same shape as the foot but somewhat smaller so that the device must be stretched to be placed over the foot. The result is that the entire foot is covered with an elastic material that cannot move with respect to the foot, and that holds the flesh on the foot quite firm. The elastic material is porous to allow perspiration to pass therethrough; and, it is contemplated that the elastic covering will be used in conjunction with an absorbent material (e.g., a knit sock of cotton or the like) so that perspiration will be conducted away from the elastic covering.

The present invention therefore provides an athletic foot protector in the form of an elastic sock of porous material to fit very tightly on the foot, the elastic sock being worn in conjunction with conventional socks to absorb perspiration. The foot protector is therefore simple to put on and easy to remove without harmful chemicals and without painful separation from the foot. Once removed, the foot protector is washable by conventional means so that it is easy to care for.

These and other features and advantages of the present invention will become apparent from consideration of the following specification when taken in conjunction with the accompanying drawings in which.

Figure 1:
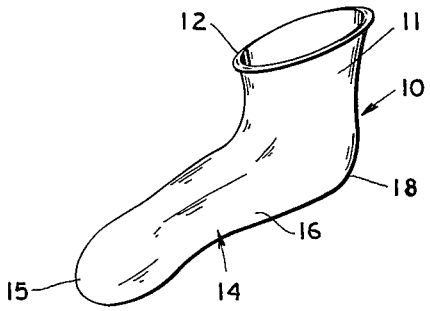
FIG. 1 is a perspective view of one form of athletic foot protector made in accordance with the present invention.

Referring now more particularly to the drawings and to that embodiment of the invention here chosen by way of illustration, FIG. 1 of the drawings illustrates a foot protector 10 for one foot. The foot protector 10 as here shown includes an ankle portion 11 having a bead 12 around the end. Though the bead 12 is not necessary to the present invention, it may be desirable to provide additional resistance to splitting at the edge of the material.

The ankle portion 11 is formed integrally with the foot portion generally designated at 14. It will be seen that the foot portion 14 is shaped to form a toe portion 15, the toe portion being shaped to conform to the toes of a foot. Rearwardly of the toe portion 15 is the metatarsal portion 16 which, it should be noted, is shaped to conform to the entire metatarsal structure of the foot, including the metatarsal arch. Then, between the metatarsal portion 16 and the ankle portion 11 is the heel portion 18.

Because of the close approximation of the shape of a foot, it may be desirable to provide the foot protector 10 in right- and left-hand foot protectors. This would be important for some feet that are less symmetrical but not completely necessary in the case of some feet that are formed more nearly symmetrical in the vicinity of the toes.

Figure 2:
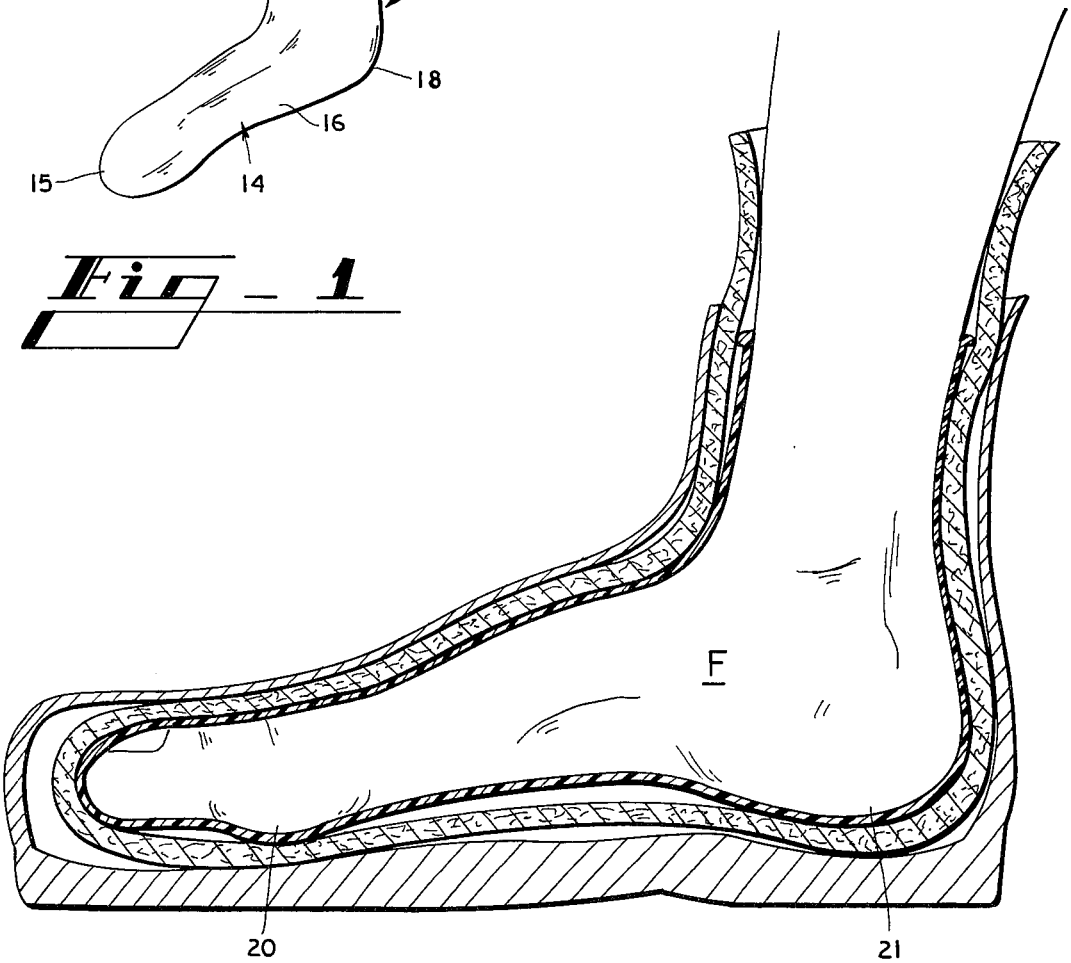
FIG. 2 is an enlarged longitudinal cross-sectional view of the foot protector shown in FIG. 1, and showing the foot protector as worn by a player with a sock and a shoe; and, FIG. 3 is a highly enlarged cross-sectional view showing the details of construction.

With the foregoing general description in mind, attention is now directed to FIG. 2 of the drawings which shows a foot F having a foot protector 10 stretched thereover. It should be noted that the foot protector 10 lies contiguously with the foot F in all areas of the foot; and, it must be realized that the foot protector 10 is of such size that the material of the foot protector 10 will be stretched.

Two of the areas most subject to traumatic action during many sports are the ball of the foot indicated at 20 and the heel indicated at 21. These are the two areas of the foot F that are the lowest areas, therefore bear the weight. The girth of the foot protector in the area of the ball of the foot 20 should be such that the foot protector 10 is stretched perimetrically, around the ball of the foot 20. With the material already stretched in order to place the foot protector around the foot, a much greater force will be required to stretch the material further because there is an opposing force, so the foot protector tends to hold the skin and flesh of the foot firmly and prevent undue motion thereof.

In conjunction with the perimetrical stretching of the foot protector 10 around the ball of the foot 20, the foot protector will be stretched in a direction longitudinally of the foot F, or from heel to toe. As an approximation of the degree of stretching, it is contemplated that the foot protector 10 will be one size smaller than the foot measurement, though it will be understood that this is an approximation only and subject to considerable variation. Nevertheless, it will be understood that the foot protector 10 is stretched in two directions in the area of the ball of the foot 20 giving good dimensional stability in two directions to hold the foot firmly.

Similar to the above described, each portion of the foot protector 10 will be stretched both perimetrically and longitudinally by being made somewhat smaller than the foot F in both length and girth, so the flesh and skin on the entire foot will be held firmly. This is less important in areas other than the ball of the foot and the heel, since other areas are not as subject to the trauma.

It is contemplated that the foot protector 10 will be formed of an elastic stretchable material such as rubber, and preferably of latex. Though the thickness is quite variable in order to achieve greater firmness, more holding force or the like, it has been found that latex of about 0.30mm in its relaxed state will serve for rather normal usage. The material is then stretched for use and becomes about 0.23 to 0.25mm thick. Thus, the material can be thin enough that there is no discomfort in wearing the foot protector, yet sufficient protection is provided.

Figure 3:
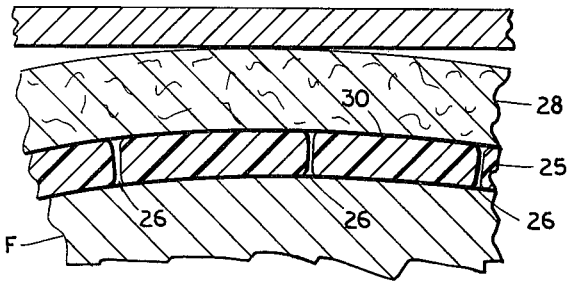

While wearing the foot protector 10, there will of course be perspiration from the foot F that must be disposed of. For this purpose, the foot protector 10 is a porous material as best shown in FIG. 3 of the drawings. Here there is a portion of the foot F having the material 25 of the foot protector 10 stretched over the foot F. As here shown, there is a plurality of pores 26 extending completely through the material 25 so that any moisture exuded by the foot F will pass through the pores 26.

On the opposite side of the material 25 from the foot F there is indicated a fibrous, absorbent material 28 which is contemplated as being in the form of a conventional sock 29 as shown in FIG. 2. The object of the absorbent material 28 is to absorb the moisture that is exuded by the foot F, so the absorbent material 28 can take numerous forms whether as a sock 29 or simply a coating or the like on the foot protector 10.

It will be understood by those skilled in the art that the pores 26 will be extremely small openings through the material 25, truly in the form of pores rather than readily discernable holes through the material 25. Thus, the pores 26 may be sufficiently small that moisture does not easily pass therethrough; however, moisture will pass through the material 25 sufficiently well because the absorbent material 28 will remove moisture from the surface 30 by a wick action. The capillary action through the pores 26 will then continue to move the moisture from the inside of the foot protector 10 to the outside where the moisture will be absorbed by the absorbent material 28.

It will now be understood that a foot protector is provided, for covering an entire foot with a porous elastic material. The elastic material is held to the foot through its own elasticity due to the fact that the material must be stretched to be placed over the foot. Once in place on the foot, the elastic material cannot move relative to the foot because of the tight fit; therefore, the elastic material acts almost as a second skin to receive the abrasions the skin is normally heir to. The combination of the porous material with an absorbent material assures that perspiration from the foot will pass through the elastic material and be conducted away by the wick action of the absorbent material.

It will of course be understood by those skilled in the art that the particular embodiment of the invention here disclosed is by way of illustration only and is meant to be in no way restrictive; therefore, numerous changes and modifications may be made, and the full use of equivalents resorted to, without departing from the spirit or scope of the invention as defined by the appended claims.

I claim:

1. A foot protector for protecting a foot having balls of the foot, a heel and toes, said foot protector comprising a sock formed of homogeneously elastomeric material shaped substantially like said foot to extend around said foot, said sock completely covering said balls of said foot, said sock having a length less than the length of said foot and a girth less than the girth of said foot so that said elastomeric material is stretched in order to cover said foot, and said material in the stretched condition has sufficient strength to absorb shear forces that cause trauma to said foot, said sock being further stretched to cover said heel of said foot, said sock defining a plurality of pores therethrough, and further including absorbent means substantially covering the outer surface of said sock.

2. A foot protector according to claim 1, wherein said absorbent means comprises a knit sock covering said porous elastic sock.

3. A method of protecting a foot from trauma due to forces applied to said foot through a shoe, said method comprising the steps of holding the flesh of said foot firm against shear forces by covering said foot with porous elastic material, said elastic material being stretched sufficiently to compress said flesh of said foot, said elastic material lying contiguous to said foot to receive abrasive forces through said shoe and retaining absorbent material in close proximity to said material for absorbing moisture as it passes through said material.

* * * * *